US011162488B2

(12) United States Patent
Mou et al.

(10) Patent No.: US 11,162,488 B2
(45) Date of Patent: Nov. 2, 2021

(54) FLUID SYSTEM

(71) Applicant: Microjet Technology Co., Ltd., Hsinchu (TW)

(72) Inventors: Hao-Jan Mou, Hsinchu (TW); Chi-Feng Huang, Hsinchu (TW); Wei-Ming Lee, Hsinchu (TW); Hsuan-Kai Chen, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 109 days.

(21) Appl. No.: 16/113,493

(22) Filed: Aug. 27, 2018

(65) Prior Publication Data

US 2019/0099774 A1 Apr. 4, 2019

(30) Foreign Application Priority Data

Sep. 29, 2017 (TW) ..... 106133647

(51) Int. Cl.
*B05B 17/06* (2006.01)
*F04B 45/047* (2006.01)

(52) U.S. Cl.
CPC ..... *F04B 45/047* (2013.01); *B05B 17/0607* (2013.01)

(58) Field of Classification Search
CPC ..... B05B 17/0607; B05B 17/0645; B05B 17/063; F04B 43/046; F04B 45/047; A61L 2209/132
(Continued)

(56) References Cited

U.S. PATENT DOCUMENTS 5,757,400 A 5/1998 Hoisington
9,611,843 B2 * 4/2017 Hsueh ..... F04B 49/22
(Continued)

FOREIGN PATENT DOCUMENTS

CN 2580141 Y 10/2003
CN 1129727 C 12/2003
(Continued)

OTHER PUBLICATIONS

Extended European Search Report for European Application No. 18190920.1, dated Nov. 9, 2018.
(Continued)

*Primary Examiner* — Joseph A Greenlund
(74) *Attorney, Agent, or Firm* — Birch, Stewart, Kolasch & Birch, LLP

(57) ABSTRACT

A fluid system includes a fluid active region, a fluid channel, a convergence chamber and plural valves. The fluid active region includes one or plural fluid-guiding units. Each fluid-guiding unit includes an inlet plate, a substrate, a resonance plate, an actuating plate, a piezoelectric element and an outlet plate, which are stacked sequentially. The piezoelectric element is attached on the actuating plate. When the piezoelectric element drives a bending resonance of the actuating plate, the fluid is transported into the fluid-guiding units and pressurized to be discharged out. The fluid channel includes plural branch channels. The fluid discharged from the fluid active region is split by the branch channels. The convergence chamber is in communication with the fluid channel. The valves are disposed in the branch channels. The fluid is transported through the branch channels according to the open/closed states of the valves.

14 Claims, 13 Drawing Sheets

(58) Field of Classification Search
USPC ..... 239/102.2
See application file for complete search history.

(56) References Cited

U.S. PATENT DOCUMENTS

| | | | | |
|---|---|---|---|---|
| 10,451,051 | B2 * | 10/2019 | Chen | F16K 99/0048 |
| 10,487,821 | B2 * | 11/2019 | Chen | F16K 99/0015 |
| 10,529,911 | B2 * | 1/2020 | Chen | F16K 99/0015 |
| 2004/0003786 | A1 | 1/2004 | Gatecliff et al. | |
| 2013/0000759 | A1 * | 1/2013 | Killeen | F04B 43/046 137/565.16 |
| 2013/0068325 | A1 * | 3/2013 | Herz | F16K 99/0048 137/565.01 |
| 2014/0286795 | A1 * | 9/2014 | Kamitani | F04B 49/007 417/62 |
| 2015/0059749 | A1 | 3/2015 | Nitta | |
| 2015/0060012 | A1 * | 3/2015 | Kamitani | F28F 27/02 165/59 |
| 2015/0150470 | A1 * | 6/2015 | Sano | F04B 43/046 600/498 |
| 2016/0348666 | A1 * | 12/2016 | Tanaka | F04D 33/00 |
| 2018/0128262 | A1 * | 5/2018 | Mou | H01L 41/0973 |

FOREIGN PATENT DOCUMENTS

| | | | |
|---|---|---|---|
| CN | 191449089 | A | 6/2009 |
| CN | 201475347 | U | 5/2010 |
| CN | 101187361 | B | 6/2010 |
| CN | 203842597 | U | 9/2014 |
| CN | 104302913 | A | 1/2015 |
| WO | WO 2010/097740 | A1 | 9/2010 |

OTHER PUBLICATIONS

Chinese Office Action and Search Report dated Oct. 9, 2019, for Chinese Application No. 201710908019.X.

* cited by examiner

FLUID SYSTEM

FIELD OF THE INVENTION

The present disclosure relates to a fluid system, and more particularly to a miniature integrated fluid system produced by an integrated process.

BACKGROUND OF THE INVENTION

Nowadays, in various fields such as pharmaceutical industries, computer techniques, printing industries or energy industries, the products are developed toward elaboration and miniaturization. The fluid transportation devices are important components that are used in, for example micro pumps, micro atomizers, print heads or industrial printers. Therefore, how to utilize an innovative structure to break through the bottleneck of the prior art has become an important part of development.

With the rapid development of science and technology, the applications of fluid transportation devices are becoming more and more diversified. For example, fluid transportation devices are gradually popular in industrial applications, biomedical applications, medical care applications, electronic cooling applications and so on, or even the most popular wearable devices. It is obvious that the fluid transportation devices gradually tend to miniaturize the structure and maximize the flow rate thereof.

Although the miniature fluid transportation device is capable of transferring gas continuously, there are still some drawbacks. For example, since the chamber or fluid channel of the miniature fluid transportation device has limited capacity, it is difficult to transfer a great amount of gas. For solving the above drawbacks, it is important to provide a gas transportation device with a valve to control the continuation or interruption of the gas transportation, control the gas to flow in one direction, accumulate the gas in the limited-capacity chamber or fluid channel and increase the amount of the gas to be discharged.

SUMMARY OF THE INVENTION

An object of the present invention is to provide an integrated fluid system to address the issues that the prior arts cannot meet the requirements of the miniature fluid system. The fluid system includes a fluid active region, a fluid channel, a convergence chamber and plural valves. The fluid active region includes one or more fluid-guiding units. Each fluid-guiding unit includes an inlet plate, a substrate, a resonance plate, an actuating plate and an outlet plate, which are stacked sequentially. A first chamber is formed between the resonance plate and the inlet plate. A gap formed between the resonance plate and the actuating plate is defined as a second chamber. A third chamber is formed between the actuating plate and the outlet plate. A piezoelectric element is attached on a surface of a suspension part of the actuating plate. While the piezoelectric element drives a bending resonance of the actuating plate, fluid is inhaled into the first chamber of the flow-guiding unit through the at least one inlet aperture of the inlet plate, transported to the second chamber through the central aperture of the resonance plate, transported to the third chamber through the vacant space of the actuating plate, and pressurized to be discharged out from the outlet aperture of the outlet plate. The fluid channel is in communication with the outlet aperture of the flow-guiding unit of the fluid active region. The fluid channel includes plural branch channels. The fluid discharged from the fluid active region is split by the branch channels. The convergence chamber is in communication with the fluid channel for allowing the fluid discharged from the fluid channel to be accumulated therein. The plural valves are disposed in the corresponding branch channels. The fluid is discharged out through the branch channels according to open/closed states of the valves.

In an embodiment, the fluid system further includes a controller. Each of the valves is an active valve, and the controller is electrically connected to the valves to control the open/closed states of the valves. The controller and the at least one fluid-guiding unit are packaged in a system-in-package manner as an integrated structure. The fluid active region includes plural fluid-guiding units. The plural fluid-guiding units are connected with each other in a serial arrangement, in a parallel arrangement or in a serial and parallel arrangement. The lengths and widths of the plural branch channels are preset according to the required amount or the flow rate of the fluid to be transported. The branch channels are connected with each other in a serial arrangement, in a parallel arrangement or in a serial and parallel arrangement.

In an embodiment, each of the valves includes a base, a piezoelectric actuator and a linking bar. The base includes a first passage and a second passage, which are separated from each other and in communication with the corresponding branch channel. A cavity is concavely formed on a surface of the base. The cavity has a first outlet and a second outlet, wherein the first outlet is in communication with the first passage, and the second outlet is in communication with the second passage. The piezoelectric actuator includes a carrier plate and a piezoelectric ceramic plate. The piezoelectric ceramic plate is attached on a first surface of the carrier plate. The cavity is covered and closed by the piezoelectric actuator. A first end of the linking bar is connected with a second surface of the carrier plate, and the linking bar is inserted into the second outlet and movable within the second outlet. A stopping part is formed at a second end of the linking bar to close the second outlet, wherein a cross section area of the stopping part has a diameter larger than the diameter of the second outlet. When the piezoelectric actuator is enabled to drive the carrier plate to move, the stopping part of the linking bar is correspondingly moved to selectively close or open the second outlet, so that the fluid is selectively transported through the corresponding branch channel. In accordance with an aspect of the embodiment, the valve allows the branch channel to be opened when the piezoelectric actuator is non-enabled, and the valve allows the branch channel to be closed when the piezoelectric actuator is enabled. In accordance with another aspect of the embodiment, the valve allows the branch channel to be closed when the piezoelectric actuator is non-enabled, and the valve allows the branch channel to be opened when the piezoelectric actuator is enabled.

From the above descriptions, the fluid system of the present disclosure has miniature volume and is capable of acquiring required flow rate, pressure and amount of the fluid to be transported.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
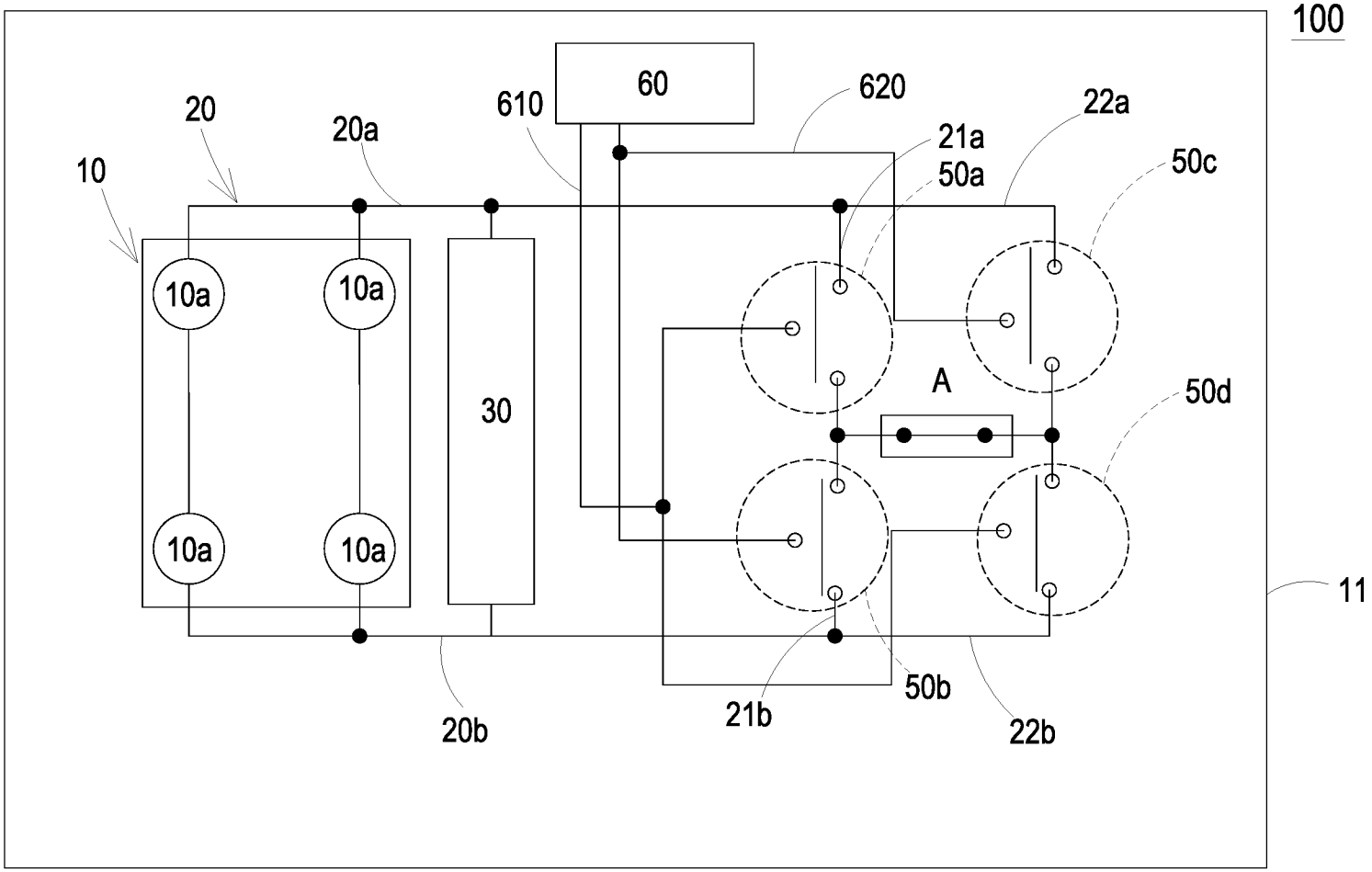
FIG. 1 schematically illustrates a fluid system according to an embodiment of the present disclosure.
Figure 2A:
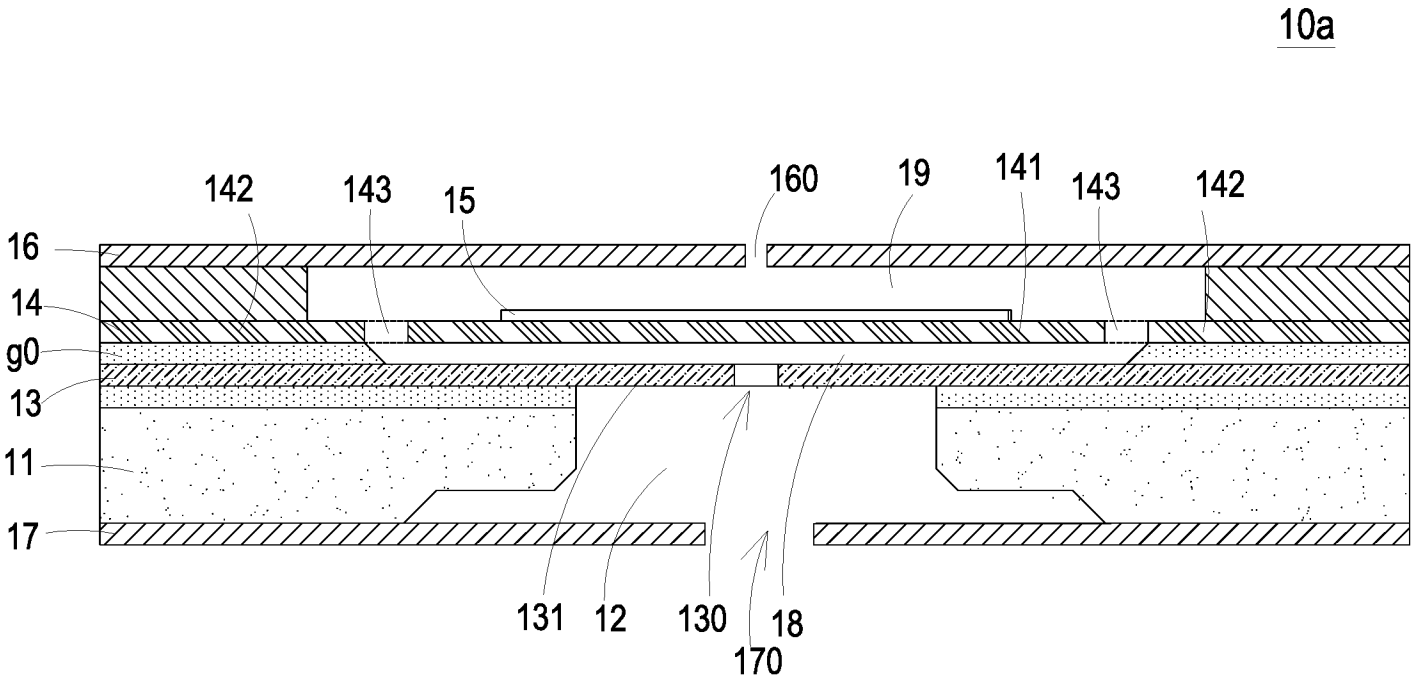
FIG. 2A is a schematic cross-sectional view illustrating a fluid-guiding unit of the fluid system according to the embodiment of the present disclosure.
Figure 2B:
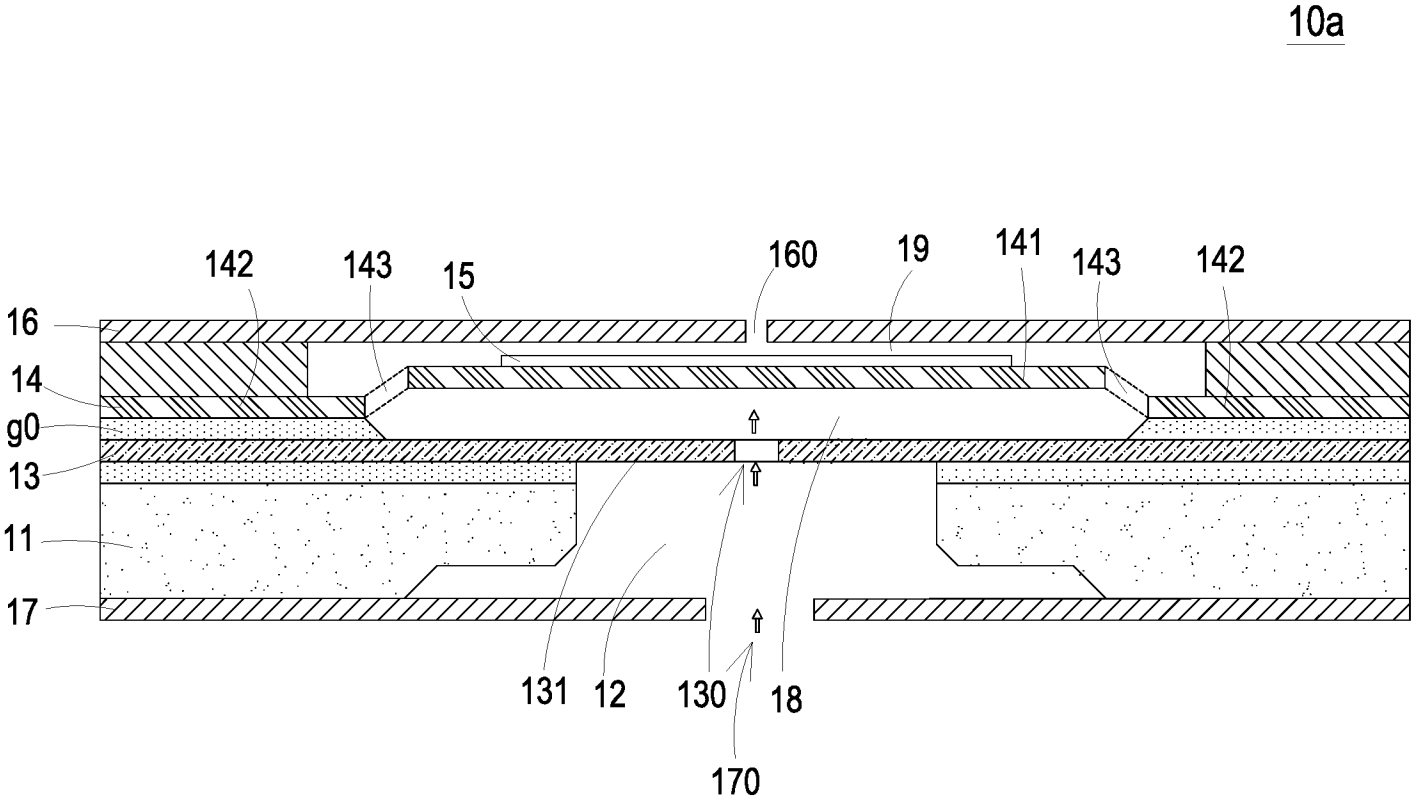
FIGS. 2B, 2C and 2D schematically illustrate the actions of the fluid-guiding unit of the fluid system of FIG. 2A.
Figure 2C:
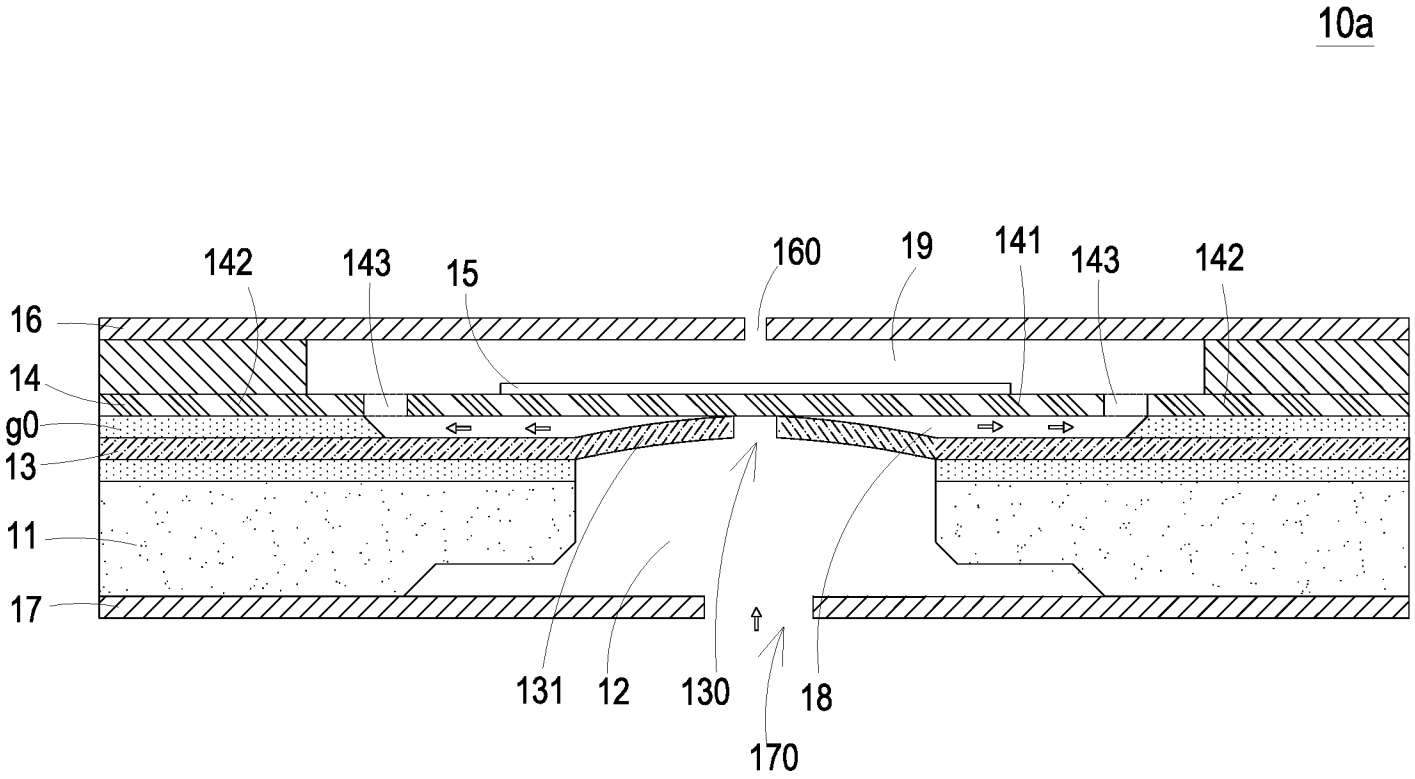
Figure 2D:
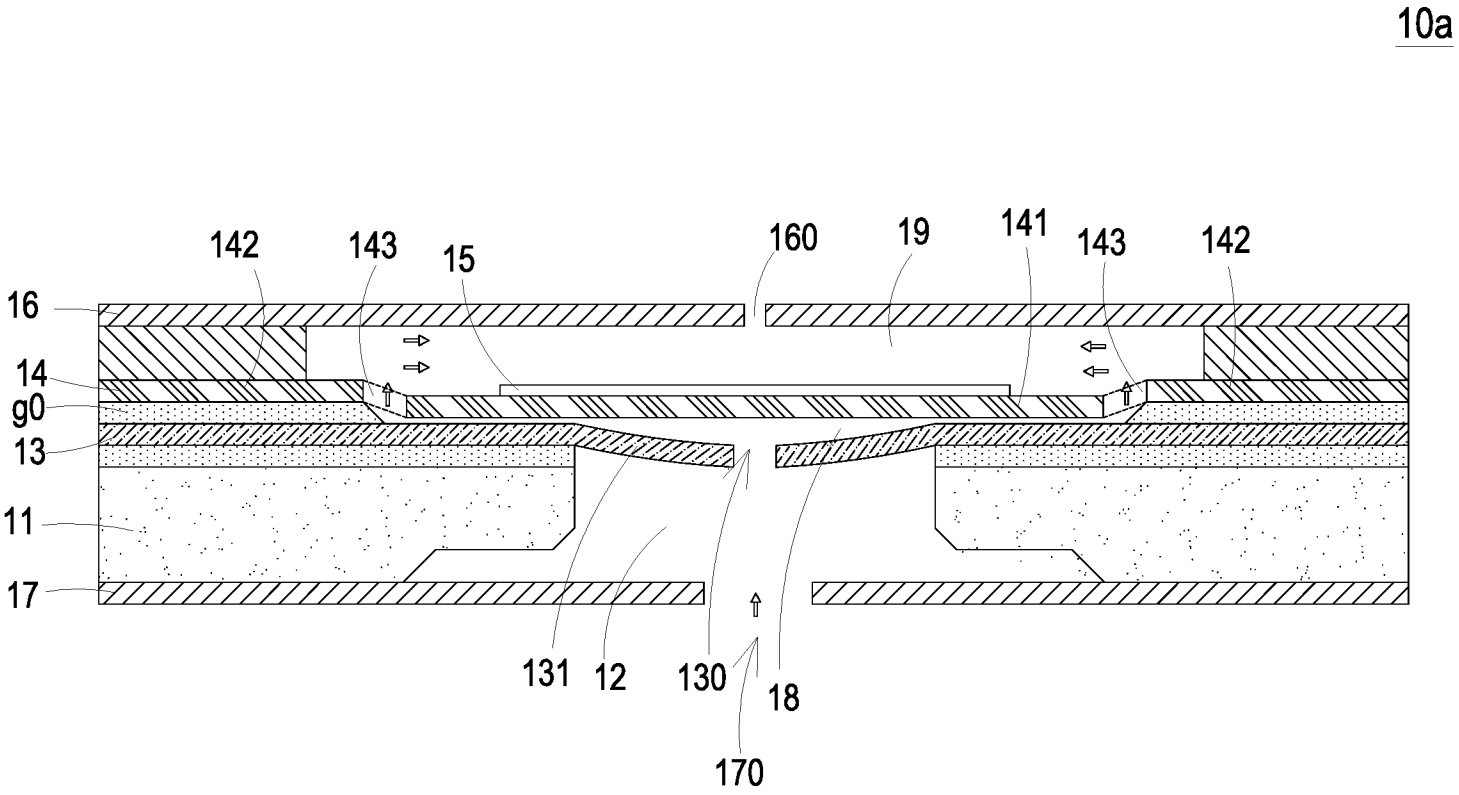

Please refer to FIGS. 1 to 2D. The present discourse provides a fluid system 100 including at least one fluid active region 10, at least one fluid-guiding unit 10*a*, at least one inlet plate 17, at least one inlet aperture 170, at least one substrate 11, at least one resonance plate 13, at least one central aperture 130, at least one first chamber 12, at least one actuating plate 14, at least one suspension part 141, at least one outer frame part 142, at least one vacant space 143, at least one piezoelectric element 15, at least one outlet plate 16, at least one outlet aperture 160, at least one gap g0, at least one second chamber 18, at least one third chamber 19, at least one pressure difference, at least one fluid channel 20, at least one convergence chamber 30 and plural valves 50, 50*a*, 50*b*, 50*c* and 50*d*. The number of the fluid active region 10, the inlet plate 17, the substrate 11, the resonance plate 13, the central aperture 130, the first chamber 12, the actuating plate 14, the suspension part 141, the outer frame part 142, the piezoelectric element 15, the outlet plate 16, the outlet aperture 160, the gap g0, the second chamber 18, the third chamber 19, the pressure difference, the fluid channel 20 and the convergence chamber 30 is exemplified by one for each in the following embodiments but not limited thereto. It should be noted that each of the fluid active region 10, the inlet plate 17, the substrate 11, the resonance plate 13, the central aperture 130, the first chamber 12, the actuating plate 14, the suspension part 141, the outer frame part 142, the piezoelectric element 15, the outlet plate 16, the outlet aperture 160, the gap g0, the second chamber 18, the third chamber 19, the pressure difference, the fluid channel 20 and the convergence chamber 30 can also be provided in plural numbers.

FIG. 1 schematically illustrates a fluid system according to an embodiment of the present disclosure. As shown in FIG. 1, the fluid system 100 includes a fluid active region 10, a fluid channel 20, a convergence chamber 30, plural valves 50*a*, 50*b*, 50*c* and 50*d*, and a controller 60. In this embodiment, the above components are packaged in a system-in-package manner on a substrate 11, so that a miniature integrated structure is formed. The fluid active region 10 includes one or plural fluid-guiding units 10*a*. The plural fluid-guiding units 10*a* are connected with each other in a serial arrangement, in a parallel arrangement or in a serial and parallel arrangement. When each fluid-guiding unit 10*a* is enabled, a pressure difference within the fluid-guiding unit 10*a* is formed, by which fluid (e.g., gas) is inhaled into the fluid-guiding unit 10*a* and pressurized to be discharged out through an outlet aperture 160 of the fluid-guiding unit 10*a* (see FIG. 2A). Consequently, the fluid is transported through the fluid-guiding unit 10*a*.

In this embodiment, the fluid active region 10 includes four fluid-guiding units 10*a*. The four fluid-guiding units 10*a* are connected with each other in a serial and parallel arrangement. The fluid channel 20 is in fluid communication with the outlet apertures 160 of the fluid-guiding units 10*a* to receive the fluid discharged from the fluid-guiding units 10*a*. The structures, actions and dispositions of the fluid-guiding unit 10*a* and the fluid channel 20 will be described as follows. The fluid channel 20 includes plural branch channels 20*a* and 20*b* to split the fluid discharged from the fluid active region 10. Consequently, the required amount of the fluid to be transported is achieved. The branch channels 20*a* and 20*b* are exemplified in the above embodiment, but the number of the branch channels is not restricted. The convergence chamber 30 is in communication with the branch channels 20*a* and 20*b*, and thus the convergence chamber 30 is in communication with the fluid channel 20. The fluid is transferred to the convergence chamber 30 to be accumulated and stored in the convergence chamber 30. When the fluid system 100 is under control to discharge the required amount of the fluid, the convergence chamber 30 can supply the fluid to the fluid channel 20 so as to increase the amount of the fluid to be transported.

As mentioned above, the fluid channel 20 includes plural branch channels 20*a* and 20*b*. As shown in FIG. 1, the branch channels 20*a* and 20*b* are connected with each other in a parallel arrangement, but not limited thereto. In some other embodiments, the branch channels 20*a* and 20*b* are connected with each other in a serial arrangement or in a serial and parallel arrangement. The lengths and widths of the branch channels 20*a* and 20*b* are preset according to the required amount of the fluid to be transported. In other words, the flow rate and amount of the fluid to be transported are influenced by the lengths and widths of the branch channels 20*a* and 20*b*. That is, the lengths and widths of the branch channels 20*a* and 20*b* may be calculated in advance according to the required amount of the fluid to be transported.

In this embodiment, the branch channel 20*a* further includes two sub-branch channels 21*a* and 22*a* (also referred as branch channels), and the branch channel 20*b* further includes two sub-branch channels 21*b* and 22*b* (also referred as branch channels). The sub-branch channels 21*a* and 22*a* of the branch channel 20*a* are connected with each other in a serial arrangement, in a parallel arrangement or in a serial and parallel arrangement. Similarly, the sub-branch channels 21*b* and 22*b* of the branch channel 20*b* are connected with each other in a serial arrangement, in a parallel arrangement or in a serial and parallel arrangement. The valves 50*a*, 50*c*, 50*b* and 50*d* may be active valves or passive valves. In this embodiment, the valves 50*a*, 50*c*, 50*b* and 50*d* are active valves, and the valves 50*a*, 50*c*, 50*b* and 50*d* are disposed in the sub-branch channels 21*a*, 22*a*, 21*b* and 22*b*, respectively. The valves 50*a*, 50*c*, 50*b* and 50*d* are selectively in an open state or a closed state to control the fluid communication state of the corresponding sub-branch channels 21*a*, 22*a*, 21*b* and 22*b*. For instance, when the valve 50*a* is in the open state, the sub-branch channel 21*a* is unobstructed to discharge the fluid to an output region A. When the valve 50*b* is in the open state, the sub-branch channel 21*b* is unobstructed to discharge the fluid to the output region A. When the valve 50*c* is in the open state, the sub-branch channel 22*a* is unobstructed to discharge the fluid to the output region A. When the valve 50*d* is in the open state, the sub-branch channel 22*b* is unobstructed to discharge the fluid to the output region A. The controller 60 includes two conductive wires 610 and 620. The conductive wire 610 is electrically connected with the control terminals of the valves 50*a* and 50*d*, and the conductive wire 620 is electrically connected with the control terminals of the valves 50*b* and 50*c*. Consequently, the open/closed states of the valves 50*a*, 50*c*, 50*b* and 50*d* can be controlled by the controller 60, so that the fluid communication states of the corresponding sub-branch channels 21*a*, 22*a*, 21*b* and 22*b* are controlled by the controller 60 for allowing the fluid to be selectively transported to the output region A. Preferably, the controller 60 and the at least one fluid-guiding unit 10*a* are packaged in a system-in-package manner as an integrated structure.

FIG. 2A is a schematic cross-sectional view illustrating a fluid-guiding unit of the fluid system according to the embodiment of the present disclosure. In an embodiment, the fluid-guiding unit 10*a* is a piezoelectric pump. As shown in FIG. 2A, each fluid-guiding unit 10*a* includes an inlet plate 17, the substrate 11, a resonance plate 13, an actuating plate 14, a piezoelectric element 15 and an outlet plate 16, which are stacked on each other sequentially. The inlet plate 17 has at least one inlet aperture 170. The resonance plate 13 has a central aperture 130 and a movable part 131. The movable part 131 is a flexible structure formed by a part of the resonance plate 13 that is not attached and fixed on the substrate 11. The central aperture 130 may be formed in the center of the movable part 131. A first chamber 12 is formed in the substrate 11 between the resonance plate 13 and the inlet plate 17. The actuating plate 14 has a hollow suspension structure and includes a suspension part 141, an outer frame part 142 and plural vacant spaces 143. The suspension part 141 of the actuating plate 14 is connected with the outer frame part 142 through plural connecting parts (not shown), so that the suspension part 141 is suspended and elastically supported by the outer frame part 142. The plural vacant spaces 143 are defined between the suspension part 141 and the outer frame part 142 for allowing the fluid to flow therethrough. The way of disposition, the types and the numbers of the suspension part 141, the outer frame part 142 and the vacant spaces 143 may be varied according to the practical requirements, but not limited thereto. Preferably but not exclusively, the actuating plate 14 may be made of a metallic film or a polysilicon film. Moreover, a gap g0 formed between the actuating plate 14 and the resonance plate 13 is defined as a second chamber 18. The outlet plate 16 has an outlet aperture 160. A third chamber 19 is formed between the actuating plate 14 and the outlet plate 16.

In some embodiments, the substrate 11 of the fluid-guiding unit 10*a* further includes a driving circuit (not shown) electrically connected to the positive electrode and the negative electrode of the piezoelectric element 15 so as to provide driving power to the piezoelectric element 15, but not limited thereto. In other embodiments, the driving circuit may be disposed at any position within the fluid-guiding unit 10*a*. The disposed position of the driving circuit may be varied according to practical requirements.

Please refer to FIG. 2A to 2C. FIGS. 2B, 2C and 2D schematically illustrate the actions of the fluid-guiding unit of the fluid system as in FIG. 2A. As shown in FIG. 2A, the fluid-guiding unit 10*a* is in a non-enabled state (i.e. in an initial state). When the piezoelectric element 15 is driven in response to an applied voltage, the piezoelectric element 15 undergoes a bending deformation to drive the actuating plate 14 to vibrate along a vertical direction in a reciprocating manner. Please refer to FIG. 2B. As the suspension part 141 of the actuating plate 14 vibrates upwardly (i.e. away from the inlet plate 17), the volume of the second chamber 18 is enlarged and the pressure in the second chamber 18 is reduced. The ambient fluid is inhaled into the fluid-guiding unit 10*a* through the inlet aperture 170 of the inlet plate 17 in response to the external air pressure, and is then converged into the first chamber 12. Then, the fluid flows into the second chamber 18 from the first chamber 12 through the central aperture 130 of the resonance plate 13, which is spatially corresponding to the first chamber 12.

Please refer to FIG. 2C. The movable part 131 of the resonance plate 13 is driven to vibrate upwardly (i.e. away from the inlet plate 17) in resonance with the vibration of the suspension part 141 of the actuating plate 14, and the suspension part 141 of the actuating plate 14 is vibrating downwardly (i.e. toward the inlet plate 17) at the same time. In such a manner, the movable part 131 of the resonance plate 13 is attached to and abuts against the suspension part 141 of the actuating plate 14. The communication space between the central aperture 130 of the resonance plate 13 and the second chamber 18 is closed. Consequently, the second chamber 18 is compressed to reduce the volume thereof and increase the pressure therein, and the volume of the third chamber 19 is enlarged and the pressure in the third chamber 19 is reduced. Under this circumstance, the pressure gradient occurs to push the fluid in the second chamber 18 to move toward a peripheral portion of the second chamber 18, and to flow into the third chamber 19 through the vacant spaces 143 of the actuating plate 14. Please refer to FIG. 2D. The suspension part 141 of the actuating plate 14 continues vibrating downwardly (i.e. toward the inlet plate 17) and drives the movable part 131 of the resonance plate 13 to vibrate downwardly (i.e. toward the inlet plate 17) along therewith, so as to further compress the first chamber 18. As a result, most of the fluid in the first chamber 18 is transported into the third chamber 19 and is temporarily stored in the third chamber 19.

Finally, the suspension part 141 of the actuating plate 14 vibrates upwardly (i.e. away from the inlet plate 17) to compress the third chamber 19, thus reducing the volume of the third chamber 19 and increasing the pressure in the third chamber 19. Therefore, the fluid stored in the third chamber 19 is discharged out to the exterior of the outlet plate 16 through the outlet aperture 160 of the outlet plate 16 so as to accomplish a fluid transportation process. The above actions and steps illustrated in FIGS. 2B, 2C and 2D indicate a complete cycle of the reciprocating vibration of the actuating plate 14. The suspension part 141 of the actuating plate 14 and the movable part 131 of the resonance plate 13 perform the above actions repeatedly under the condition of that the piezoelectric element 15 is enabled. Consequently, the fluid is continuously inhaled into the inlet aperture 170 to be pressurized and discharged out through the outlet aperture 160. In such way, the purpose of fluid transportation is achieved. In some embodiments, the vibration frequency of the resonance plate 13 along the vertical direction in the reciprocating manner may be identical to the vibration frequency of the actuating plate 14. That is, the resonance plate 13 and the actuating plate 14 synchronously vibrate along the upward direction or the downward direction. It should be noted that numerous modifications and alterations of the actions of the fluid-guiding unit 10*a* may be made while retaining the teachings of the disclosure.

In this embodiment, the fluid-guiding unit 10*a* can generate a pressure gradient in the designed fluid channels of itself to facilitate the fluid to flow at a high speed. Since there is an impedance difference between the inlet direction and the outlet direction, the fluid can be transported from an inhale end to a discharge end of the fluid-guiding unit 10*a*. Moreover, even if a gas pressure exists at the discharge end, the fluid-guiding unit 10*a* still has the capability to discharge out the fluid while achieving the silent efficacy.

Figure 3A:
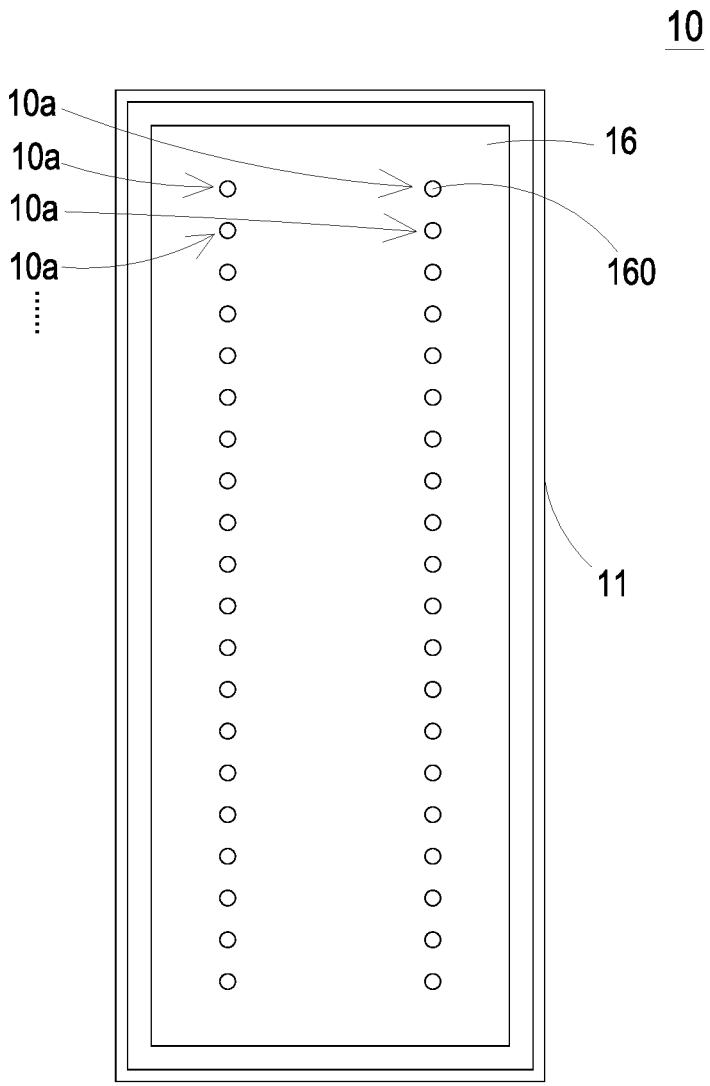
FIG. 3A schematically illustrates the fluid active region of the fluid system as shown in FIG. 1.

Referring to FIG. 3A, which schematically illustrates the fluid active region of the fluid system as shown in FIG. 1, the fluid active region 10 includes plural fluid-guiding units 10*a*. The amount of the fluid to be discharged from the fluid active region 10 is adjusted according to the arrangement of the fluid-guiding units 10*a*. In this embodiment, the plural fluid-guiding units 10*a* are disposed on the substrate 11 and connected with each other in a serial and parallel arrangement.

Figure 3B:
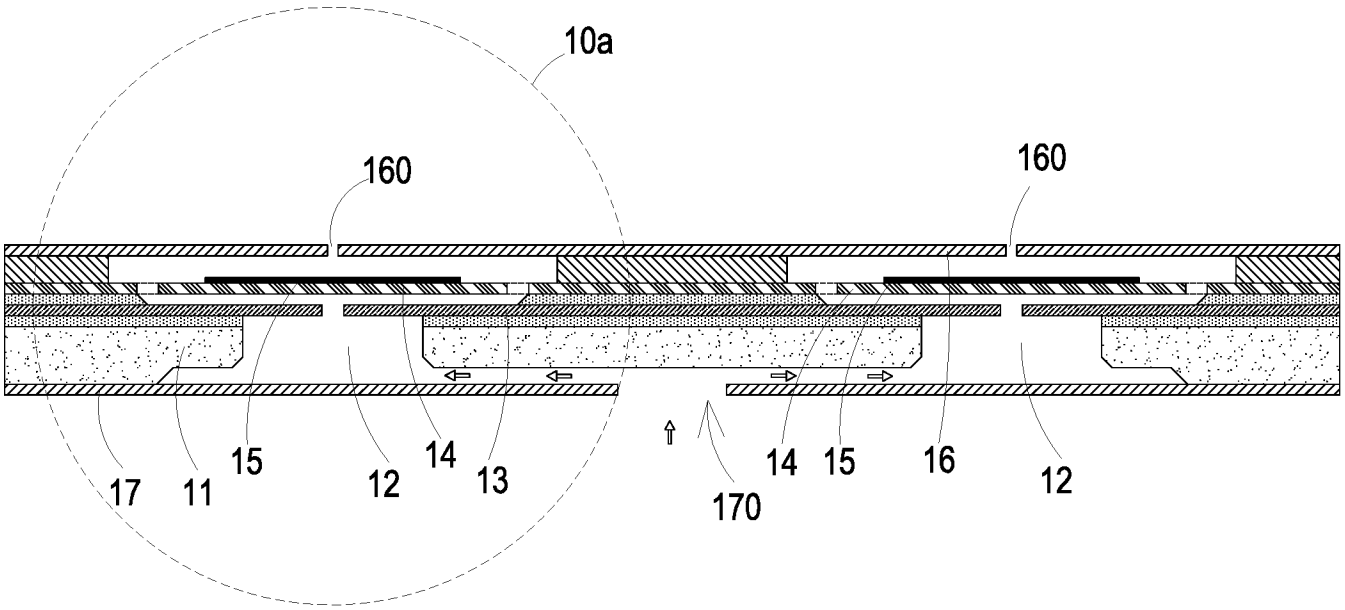
FIG. 3B schematically illustrates a portion of the fluid active region of the fluid system, in which the fluid-guiding units are connected with each other in a serial arrangement.
Figure 3C:
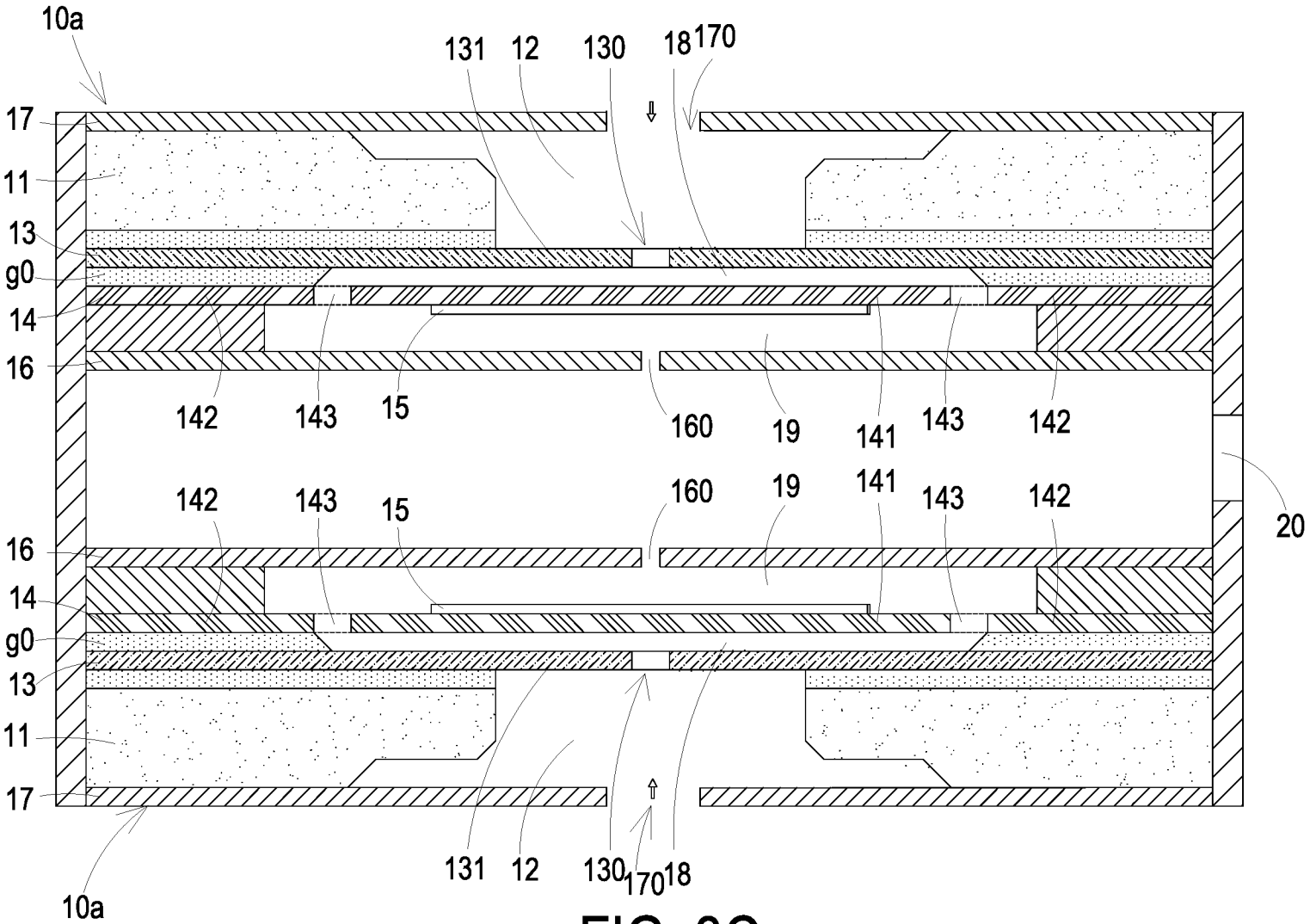
FIG. 3C schematically illustrates a portion of the fluid active region of the fluid system, in which the fluid-guiding units are connected with each other in a parallel arrangement.
Figure 3D:
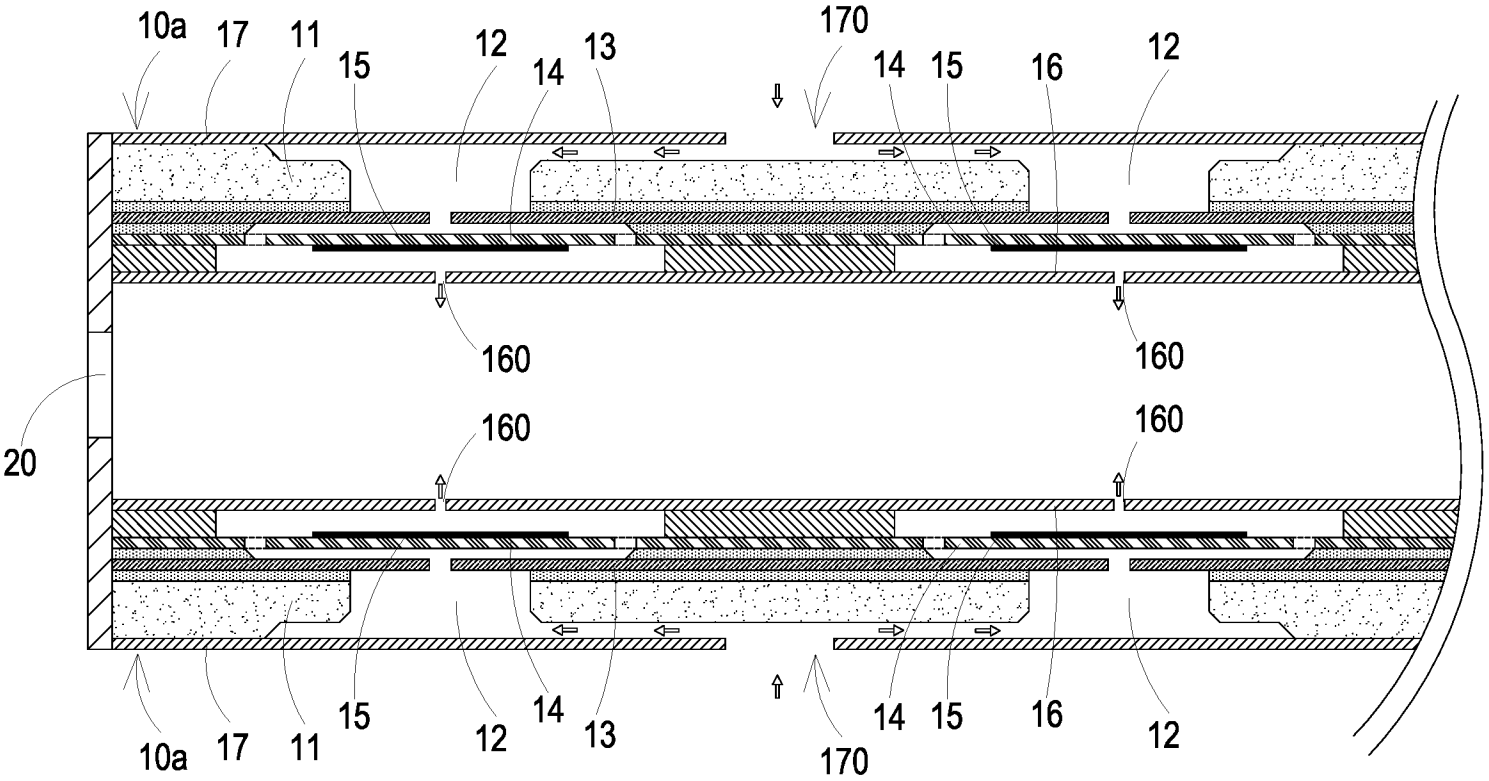
FIG. 3D schematically illustrates a portion of the fluid active region of the fluid system, in which the fluid-guiding units are connected with each other in a serial and parallel arrangement.

Please refer to FIGS. 3B, 3C and 3D. FIG. 3B schematically illustrates a portion of the fluid active region of the fluid system, in which the fluid-guiding units are connected with each other in a serial arrangement. FIG. 3C schematically illustrates a portion of the fluid active region of the fluid system, in which the fluid-guiding units are connected with each other in a parallel arrangement. FIG. 3D schematically illustrates a portion of the fluid active region of the fluid system, in which the fluid-guiding units are connected with each other in a serial and parallel arrangement. As shown in FIG. 3B, the fluid-guiding units 10*a* of the fluid active region 10 are connected with each other in a serial arrangement. Since the fluid-guiding units 10*a* are connected with each other in series, the pressure of the fluid at the outlet apertures 160 of the fluid active region 10 is increased. As shown in FIG. 3C, the fluid-guiding units 10*a* of the fluid active region 10 are connected with each other in a parallel arrangement. Since the fluid-guiding units 10*a* are connected with each other in parallel, the amount of the fluid to be discharged out from the outlet apertures 160 of the fluid active region 10 is increased. As shown in FIG. 3D, the fluid-guiding units 10*a* of the fluid active region 10 are connected with each other in a serial and parallel arrangement. Consequently, the pressure of the fluid and the amount of the fluid to be discharged out from the fluid active region 10 are both increased.

Figure 4:
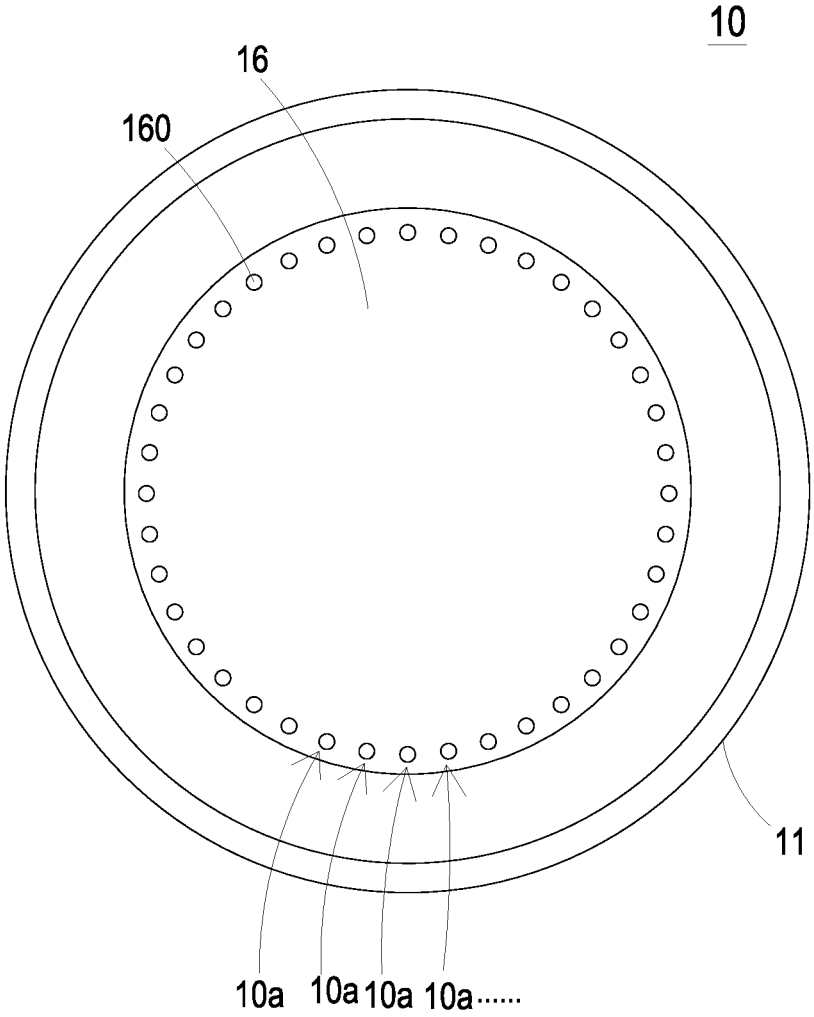
FIG. 4 schematically illustrates the fluid active region of the fluid system according to another embodiment of the present disclosure.
Figure 5:
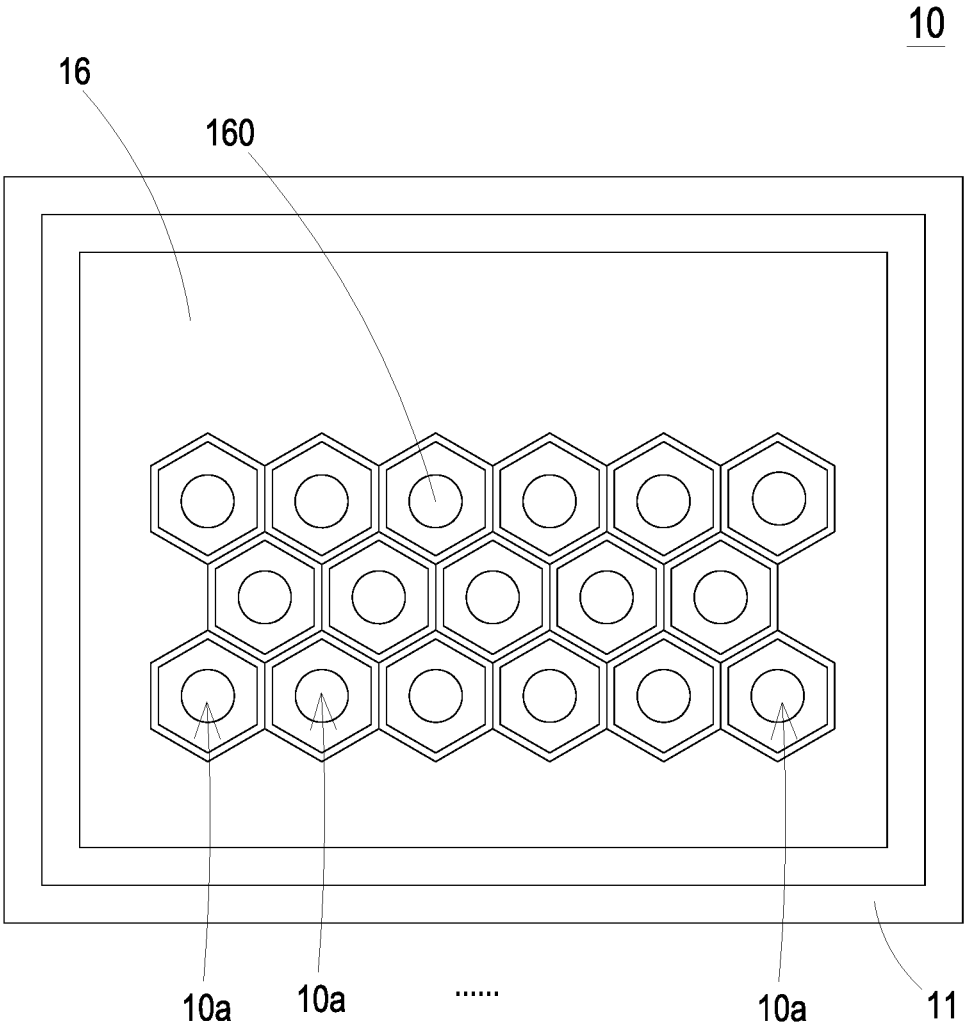
FIG. 5 schematically illustrates the fluid active region of the fluid system according to further another embodiment of the present disclosure.

Please refer to FIGS. 4 and 5. FIG. 4 schematically illustrates the fluid active region of the fluid system according to another embodiment of the present disclosure. FIG. 5 schematically illustrates the fluid active region of the fluid system according to further another embodiment of the present disclosure. According to the embodiment shown in FIG. 4, the fluid-guiding units 10*a* of the fluid active region 10 are connected with each other in a ring-shaped arrangement so as to transport the fluid. According to the embodiment shown in FIG. 5, the fluid-guiding units 10*a* of the fluid active region 10 are connected with each other in a honeycomb arrangement.

It can be seen from the above description that the fluid-guiding units 10*a* of the fluid system 100 have high flexibility in assembling arrangement as long as being connected with the driving circuit, which make them suitably applied to various electronic components. Moreover, the fluid-guiding units 10*a* of fluid system 100 may be enabled to transport fluid simultaneously so as to transport a great amount of fluid according to the practical requirements. Moreover, two fluid-guiding units 10*a* may be individually controlled to be enabled or disabled. For example, one fluid-guiding unit 10*a* is enabled, and the other fluid-guiding unit 10*a* is disabled. Another example is that the two fluid-guiding units 10*a* are alternately enabled, but not limited thereto. Consequently, the purpose of transporting various amount of the fluid and the purpose of reducing the power consumption can be achieved.

Figure 6A:
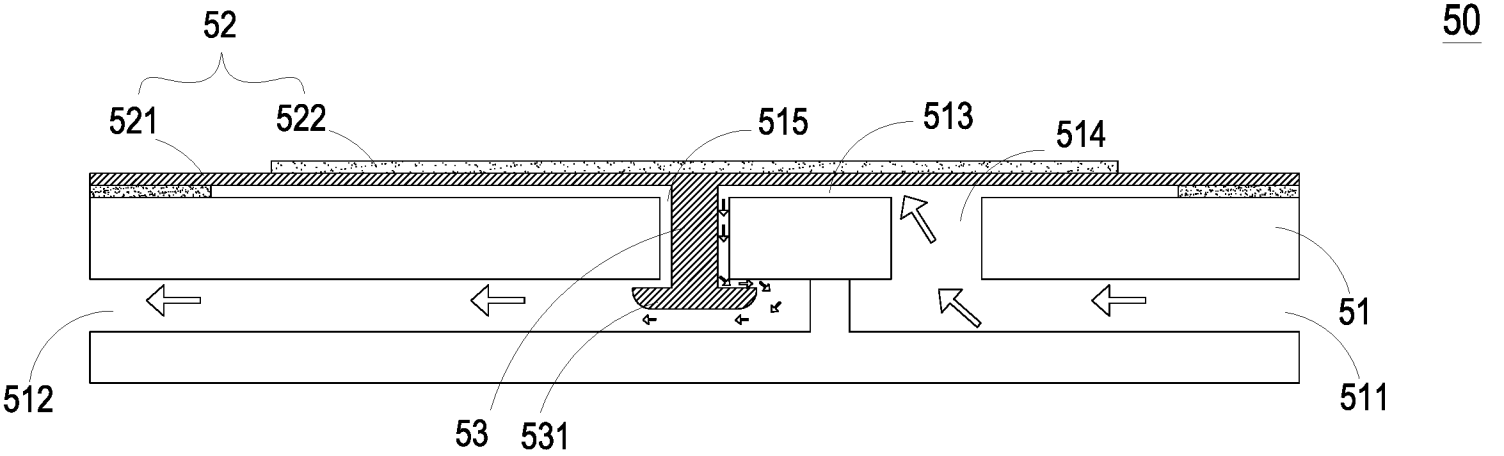
FIGS. 6A and 6B are schematic cross-sectional views illustrating the actions of the valve used in the fluid system according to a first aspect of the embodiment of the present disclosure.
Figure 6B:
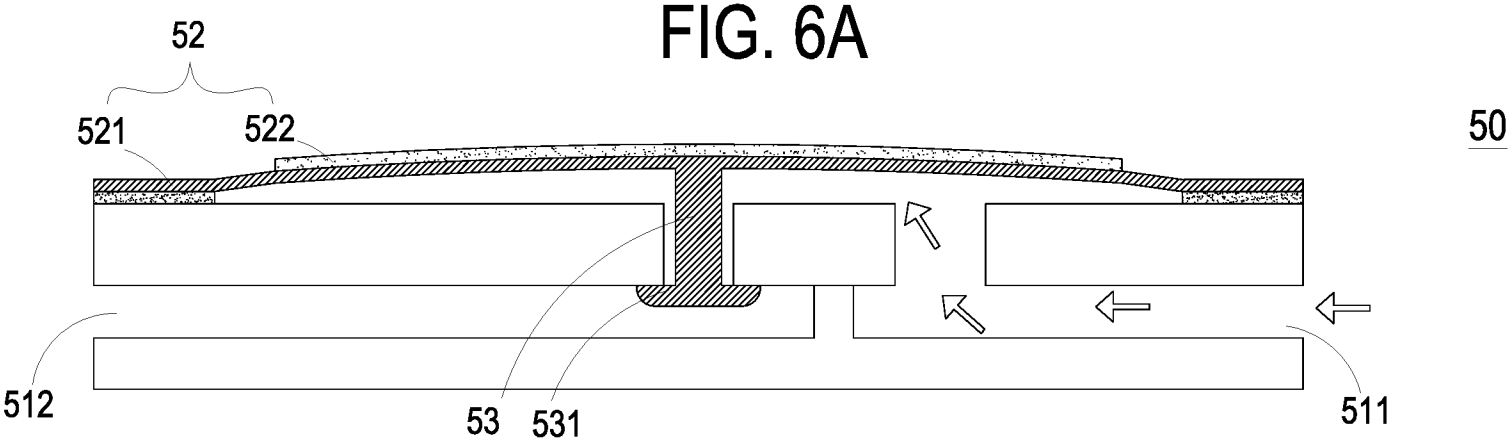

FIGS. 6A and 6B are schematic cross-sectional views illustrating the actions of the valve used in the fluid system according to a first aspect of the present disclosure. According to the first aspect of the present disclosure, the valve 50 includes a base 51, a piezoelectric actuator 52 and a linking bar 53. The valve 50 is exemplified as being disposed in the sub-branch channel 21*a*. The structures and actions of the valves 50 disposed in the other sub-branch channels 22*a*, 21*b* and 22*b* are similar to the structure and the actions of the valve 50 disposed in the sub-branch channel 21*a*, and are not redundantly described herein. The base 51 includes a first passage 511 and a second passage 512, which are in communication with the sub-branch channel 21*a* and are separated from each other by a partial structure of the base 51. A cavity 513 is concavely formed on the top surface of the base 51. The cavity 513 has a first outlet 514 and a second outlet 515. The first outlet 514 is in communication with the first passage 511, and the second outlet 515 is in communication with the second passage 512. The piezoelectric actuator 52 includes a carrier plate 521 and a piezoelectric ceramic plate 522. The carrier plate 521 may be made of a flexible material. The piezoelectric ceramic plate 522 is attached on a first surface of the carrier plate 521 and electrically connected to the controller 60. The piezoelectric actuator 52 is located over the cavity 513 to cover the cavity 513, so that the cavity 513 is closed. A first end of the linking bar 53 is connected with a second surface of the carrier plate 521, and the linking bar 53 is inserted into the second outlet 515 and is movable within the second outlet 515 along a vertical direction. A second end of the linking bar 53 is formed as a stopping part 531 to be used to close the second outlet 515. The cross section area of the stopping part 531 has a diameter larger than the diameter of the second outlet 515. Preferably but not exclusively, the stopping part 531 may be a flat plate structure or a mushroom-shaped structure.

Please refer to FIG. 6A. When the piezoelectric actuator 52 of the valve 50 is not enabled, the linking bar 53 is in an initial position and in a normally open state. Meanwhile, a communication space is formed between the stopping part 531 and the second outlet 515 for allowing the second passage 512, the cavity 513 and the first passage 511 to be in fluid communication with each other and in fluid communication with the sub-branch channel 21*a*, so that the fluid is allowed to flow therethrough. On the contrary, referring to FIG. 6B, when the piezoelectric actuator 52 is enabled, the carrier plate 521 is driven to undergo upward bending deformation by the piezoelectric ceramic plate 522, so that the linking bar 53 is driven to move upwardly by the carrier plate 521. Consequently, the second outlet 515 is closed by being covered by the stopping part 531, and the fluid cannot be transported through the second outlet 515. In such way, the valve 50 makes the sub-branch channel 21*a* in the open state when the valve 50 is non-enabled, and the valve 50 makes the sub-branch channel 21*a* in the closed state when the valve 50 is enabled. In other words, the fluid is selectively transported through the branch channel 21*a*, which is controlled by a fluid communication state of the second passage 512 of the valve 50.

Figure 7A:
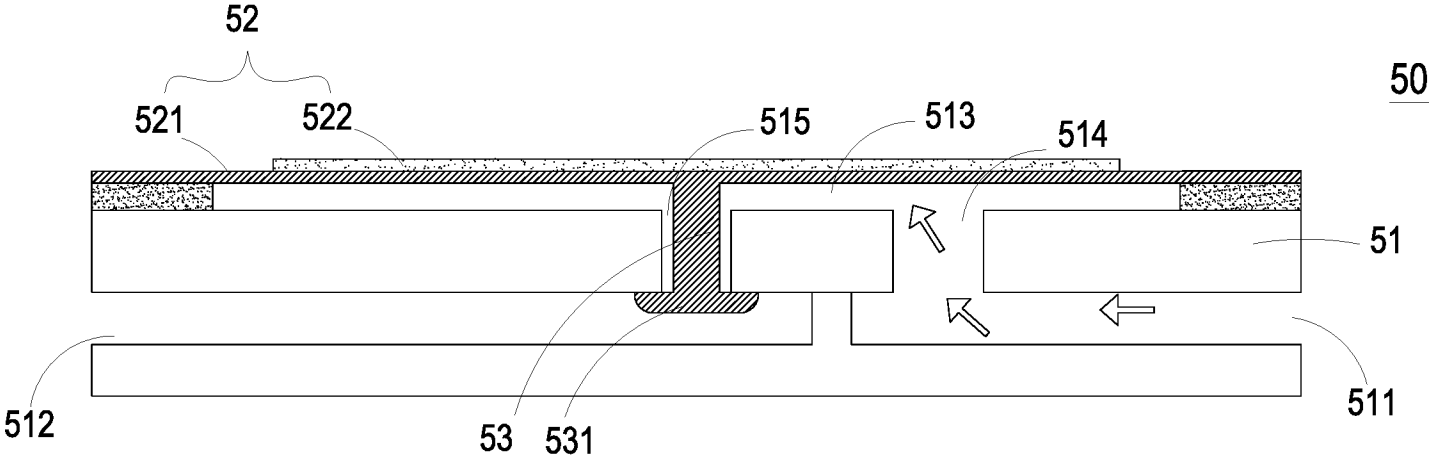
FIGS. 7A and 7B are schematic cross-sectional views illustrating the actions of the valve used in the fluid system according to a second aspect of the embodiment of the present disclosure.
Figure 7B:
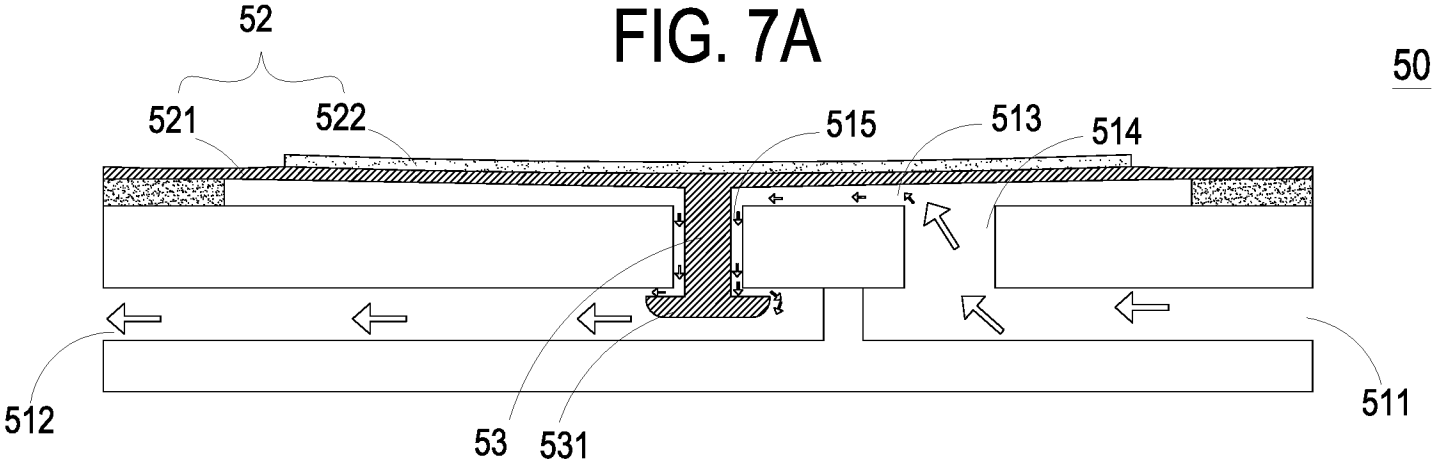

FIGS. 7A and 7B are schematic cross-sectional views illustrating the actions of the valve used in the fluid system according to a second aspect of the present disclosure. According to the second aspect of the present disclosure, the structure of the valve 50 is similar to that of FIGS. 6A and 6B. In contrast, the valve 50 is in a normally closed state when the valve 50 is not enabled.

Please refer to FIG. 7A. When the piezoelectric actuator 52 of the valve 50 is not enabled, the linking bar 53 is in an initial position and in a normally closed state. Meanwhile, the second outlet 515 is closed by being covered by the stopping part 531, and the fluid cannot be transported through the second outlet 515. Please refer to FIG. 7B. When the piezoelectric actuator 52 is enabled, the carrier plate 521 is driven to undergo downward bending deformation by the piezoelectric ceramic plate 522, so that the linking bar 53 is driven to move downwardly by the carrier plate 521. Under this circumstance, a communication space is formed between the stopping part 531 and the second outlet 515 for allowing the second passage 512, the cavity 513 and the first passage 511 to be in fluid communication with each other and in fluid communication with the sub-branch channel 21*a*, so that the fluid is allowed to flow therethrough. In such way, the valve 50 makes the sub-branch channel 21*a* in the closed state when the valve 50 is non-enabled, and the valve 50 makes the sub-branch channel 21*a* in the open state when the valve 50 is enabled. In other words, the fluid is selectively transported through the branch channel 21*a*, which is controlled by a fluid communication state of the second passage 512 of the valve 50.

From the above descriptions, the present disclosure provides the fluid system using the at least one fluid-guiding unit for transporting the fluid to the convergence chamber. The valves disposed in the branch channels are used to control and adjust the amount, flow rate and pressure of the fluid to be discharged from the fluid system. The numbers, arrangements and driving methods of the at least one fluid-guiding unit and the branch channels may be flexibly varied according to the practical requirements. In other words, the fluid system of the present disclosure can provide the efficacy of transporting a great amount of fluid in a high performance and high flexible manner according to various applied devices and required amount of fluid to be transported.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluid system produced by an integrated process, comprising:

a fluid active region comprising at least one fluid-guiding unit each of which comprises:

an inlet plate comprising at least one inlet aperture;

a substrate;

a resonance plate having a central aperture, wherein a first chamber is formed between the resonance plate and the inlet plate;

an actuating plate having a suspension part, an outer frame part and at least one vacant space;

a piezoelectric element attached on a surface of the suspension part of the actuating plate; and an outlet plate having an outlet aperture, wherein the inlet plate, the substrate, the resonance plate, the actuating plate and the outlet plate are stacked sequentially, a gap formed between the resonance plate and the actuating plate is defined as a second chamber, and a third chamber is formed between the actuating plate and the outlet plate, wherein the piezoelectric element drives a bending resonance of the actuating plate to generate a pressure difference between the second chamber and the third chamber so that a fluid is inhaled into the first chamber through the at least one inlet aperture of the inlet plate, transported to the second chamber through the central aperture of the resonance plate, transported to the third chamber through the at least one vacant space, and discharged out through the outlet aperture of the outlet plate;

a fluid channel in communication with the outlet aperture of the fluid active region, and comprising plural branch channels, wherein the fluid discharged from the fluid active region is split by the branch channels, so that a predetermined amount of the fluid to be transported is achieved;

a convergence chamber in communication with the fluid channel for allowing the fluid to be accumulated therein; and a plurality of valves, each of which disposed in the corresponding branch channel and electrically connected to a controller, wherein the fluid is discharged out to an output region through the corresponding branch channel according to an open/closed state of the valve disposed therein, and the open/closed states of the plural valves are actively controlled by the controller.

2. The fluid system according to claim 1, wherein the at least one fluid-guiding unit of the fluid active region comprises plural fluid-guiding units, and the plural fluid-guiding units are connected with each other in a serial arrangement to transport the fluid.

3. The fluid system according to claim 1, wherein the at least one fluid-guiding unit of the fluid active region comprises plural fluid-guiding units, and the plural fluid-guiding units are connected with each other in a parallel arrangement to transport the fluid.

4. The fluid system according to claim 1, wherein the at least one fluid-guiding unit of the fluid active region comprises plural fluid-guiding units, and the plural fluid-guiding units are connected with each other in a serial and parallel arrangement to transport the fluid.

5. The fluid system according to claim 1, wherein the at least one fluid-guiding unit of the fluid active region comprises plural fluid-guiding units, and the plural fluid-guiding units are connected with each other in a ring-shaped arrangement to transport the fluid.

6. The fluid system according to claim 1, wherein the at least one fluid-guiding unit of the fluid active region comprises plural fluid-guiding units, and the plural fluid-guiding units are connected with each other in a honeycomb arrangement to transport the fluid.

7. The fluid system according to claim 1, wherein the lengths of the plural branch channels are preset according to the predetermined amount of the fluid to be transported.

8. The fluid system according to claim 1, wherein the widths of the plural branch channels are preset according to the predetermined amount of the fluid to be transported.

9. The fluid system according to claim 1, wherein each of the valves comprises:

a base comprising a first passage and a second passage separated from each other and in communication with the corresponding branch channel, wherein a cavity is concavely formed on a surface of the base, and the cavity comprises a first outlet in communication with the first passage and a second outlet in communication with the second passage;

a piezoelectric actuator comprising a carrier plate and a piezoelectric ceramic plate, wherein the piezoelectric ceramic plate is attached on a first surface of the carrier plate, and the cavity of the base is covered and closed by the piezoelectric actuator; and a linking bar having a first end and a second end, wherein the first end of the linking bar is connected with a second surface of the carrier plate, the linking bar is inserted into the second outlet and movable within the second outlet, and a stopping part is formed at the second end of the linking bar for closing the second outlet, wherein a cross section area of the stopping part has a diameter larger than the diameter of the second outlet, wherein when the piezoelectric actuator is enabled to drive, the carrier plate is driven to move, and the stopping part of the linking bar is correspondingly moved to selectively close or open the second outlet, so that the fluid is selectively transported through the corresponding branch channel.

10. The fluid system according to claim 1, wherein the controller and the at least one fluid-guiding unit are packaged in a system-in-packaged as an integrated structure.

11. The fluid system according to claim 1, wherein the plural branch channels are connected with each other in a serial arrangement.

12. The fluid system according to claim 1, wherein the plural branch channels are connected with each other in a parallel arrangement.

13. The fluid system according to claim 1, wherein the plural branch channels are connected with each other in a serial and parallel arrangement.

14. A fluid system produced by an integrated process, comprising:

at least one fluid active region comprising at least one fluid-guiding unit each of which comprises:

at least one inlet plate comprising at least one inlet aperture;

at least one substrate;

at least one resonance plate having at least one central aperture, wherein at least one first chamber is formed between the resonance plate and the inlet plate;

at least one actuating plate having at least one suspension part, at least one outer frame part and at least one vacant space;

at least one piezoelectric element attached on a surface of the suspension part of the actuating plate; and at least one outlet plate having at least one outlet aperture, wherein the inlet plate, the substrate, the resonance plate, the actuating plate and the outlet plate are stacked sequentially, at least one gap formed between the resonance plate and the actuating plate is defined as at least one second chamber, and at least one third chamber is formed between the actuating plate and the outlet plate, wherein the piezoelectric element drives a bending resonance of the actuating plate to generate at least one pressure difference between the second chamber and the third chamber so that a fluid is inhaled into the first chamber through the at least one inlet aperture of the inlet plate, transported to the second chamber through the central aperture of the resonance plate, transported to the third chamber through the at least one vacant space, and discharged out through the outlet aperture of the outlet plate;

at least one fluid channel in communication with the outlet aperture of the fluid active region, and comprising plural branch channels, wherein the fluid discharged from the fluid active region is split by the branch channels, so that a predetermined amount of the fluid to be transported is achieved;

at least one convergence chamber in communication with the fluid channel for allowing the fluid to be accumulated therein; and a plurality of valves, each of which disposed in the corresponding branch channel and electrically connected to a controller, wherein the fluid is discharged out to an output region through the corresponding branch channel according to an open/closed state of the valve disposed therein, and the open/closed states of the plural valves are actively controlled by the controller.

* * * * *